US005388356A

United States Patent [19]

Kalivas

[11] Patent Number: 5,388,356

[45] Date of Patent: Feb. 14, 1995

[54] CHANGEABLE NUMERICAL CHARACTERS FOR A DISPLAY SIGN

[76] Inventor: Timothy Kalivas, 138 Pine Neck Ave., Patchogue, N.Y. 11772

[21] Appl. No.: 752,832

[22] Filed: Aug. 30, 1991

[51] Int. Cl.[6] ..... G09F 11/00

[52] U.S. Cl. ..... 40/450

[58] Field of Search ..... 40/450, 447

[56] References Cited

U.S. PATENT DOCUMENTS

| | | | |
|---|---|---|---|
| 687,487 | 11/1901 | Powell . | |
| 1,046,963 | 12/1912 | Burgquist . | |
| 1,144,096 | 6/1915 | Becker . | |
| 1,247,458 | 11/1917 | Senn . | |
| 1,833,793 | 11/1931 | Pfleger . | |
| 3,094,801 | 5/1963 | Becker . | |
| 3,486,258 | 12/1969 | Mueller . | |
| 3,518,963 | 7/1970 | Tucker . | |
| 3,740,878 | 6/1973 | Oelschlaeger | 40/447 |
| 3,991,496 | 11/1976 | Helwig et al. . | |
| 4,005,536 | 2/1977 | Fanning, Jr. . | |
| 4,024,532 | 5/1977 | Sherwin . | |
| 4,040,193 | 8/1977 | Matsuda et al. . | |
| 4,411,084 | 10/1983 | Kraus | 40/450 |
| 4,542,603 | 9/1985 | Streeter | 40/447 |

*Primary Examiner*—Kenneth J. Dorner
*Assistant Examiner*—J. Bonifanti
*Attorney, Agent, or Firm*—Nolte, Nolte and Hunter

[57] ABSTRACT

A numeric display has a background and seven panels positioned to form a stylized FIG. 8. The seven panels include four vertical panels, each revoluably mounted about a horizontal axle, and three horizontal panels each revoluably mounted about a vertical axis. The axis of each of said seven bars pass substantially through the geometric center the panel. The panels each have a front face and a back face. The front face of the panels contrasts optically with the background. The rear face optically melds with the background.

8 Claims, 2 Drawing Sheets

CHANGEABLE NUMERICAL CHARACTERS FOR A DISPLAY SIGN

BACKGROUND OF THE INVENTION

The present invention relates to construction and arrangement of moveable portions to display numerical characters, such, for example, as the current prices of fuels at service stations or grocery, dairy products and fruit sold from grocery stores and stands along a roadside.

An object of the invention is to .provide numerical characters that may be large enough to be legible along the roadside and to be readily changeable as prices fluctuate rapidly in such wares and goods.

Many previous attempts have been made for display signs of this nature, including removable numerals which are in themselves unhandy, and also in employing moveable sections having contrasting and non-contrasting faces against a background member. For example, the patent to Steeter et al. 4,542,603 shows a background having contrasting and non-contrasting flaps hinged to cover non-contrasting and contrasting areas to achieve the desired results of changeable numerals. The Streeter structure requires a spatula-like instrument (26) to flip the flaps to expose or obliterate patterns that may be formed into the numerals 0 through 9. Because the flaps are hinged, they are unbalanced and can be disturbed by winds or else must be constructed and hinged of heavy gauge members.

It is an object of the present invention to design such a numeric display that may be readily manipulated in place by rotation about central parallel axis of each segment. It is a further object to provide a simpler structure in which the numerical indicia, per se, determine the numerical symbol; i.e. no part of the background serves as a portion of the indicia.

It is an object of the invention to utilize the seven bars or facets of a squared or rectangular FIG. 8 to form all ten of the Arabic numeric symbols by mounting each of the bars on a central axis or axle to rotate the bar to selectively present the contrasting or non-contrasting color or pattern required to present the selected numeric symbol.

It is a further object of the invention to provide such a display sign that is not readily subject to alteration or dismemberment by wind. It is an object to provide seven moveable parts which are symmetrically balanced around axles so that they do not tend to be moved by wind or may be further secured by relatively light clamps.

DETAILED DESCRIPTION OF THE DRAWINGS

Figure 1:
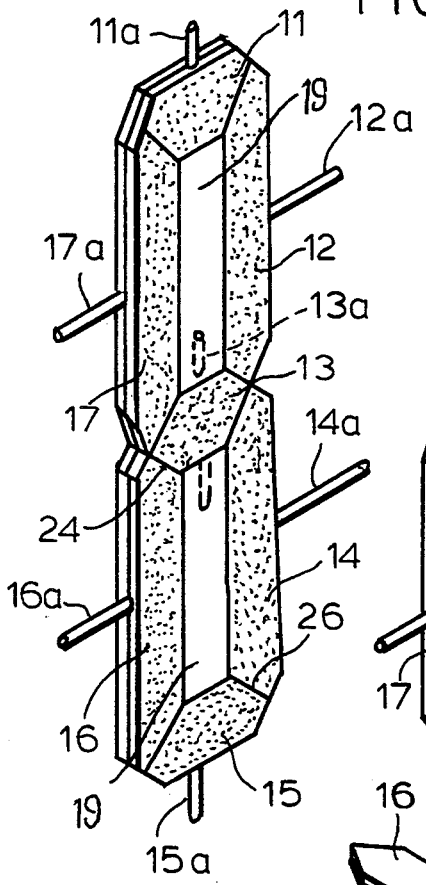
FIG. 1 is a perspective view of one of the alterable numerals, illustrating the symbol 8.
Figure 2:
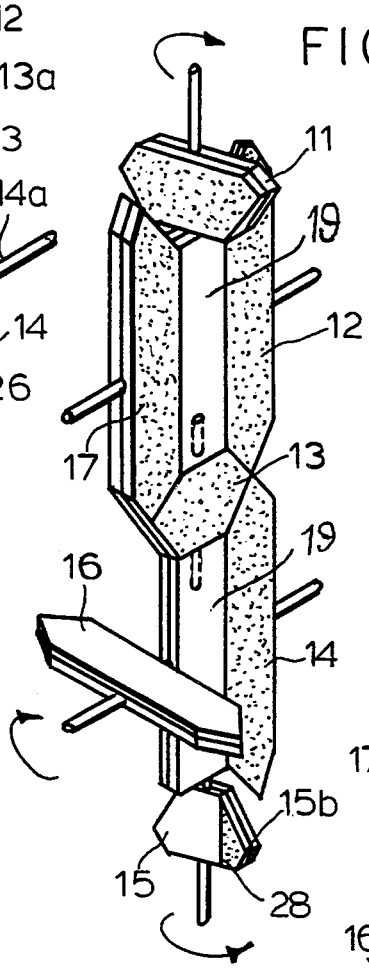
FIG. 2 is a perspective view of the same showing an intermediate step in alteration of the numeral to a different symbol.
Figure 3:
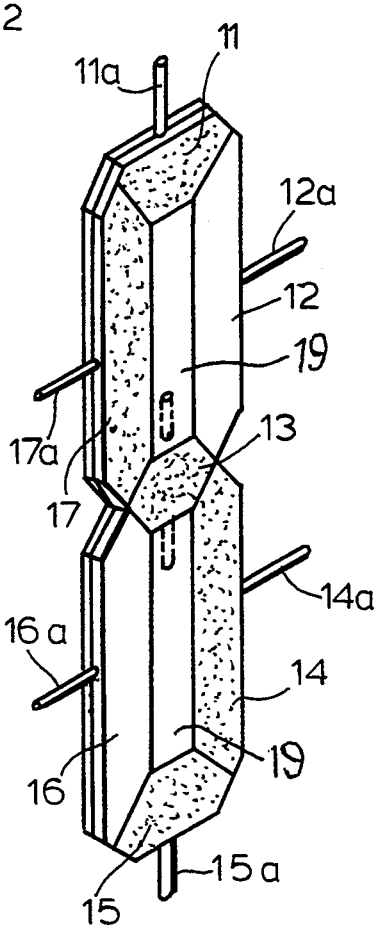
FIG. 3 shows the numeral altered to display Arabic 5.

Referring to FIG. 1, 2 and 3 of the drawings, there is shown the seven bar numeric display having the bars 11, 12, 13, 14, 15, 16 and 17, the horizontal bars 11, 13 and 15 are pivoted on centrally located vertical spindles indicated at 11*a*, 13*a* and 15*a*. Vertical bars 12, 14, 16 and 17 are mounted on centrally located horizontal spindles identified as 12*a*, 14*a*, 16*a* and 17*a*, respectively. The seven bars are similar in function to electronic digital displays.

Figure 4:
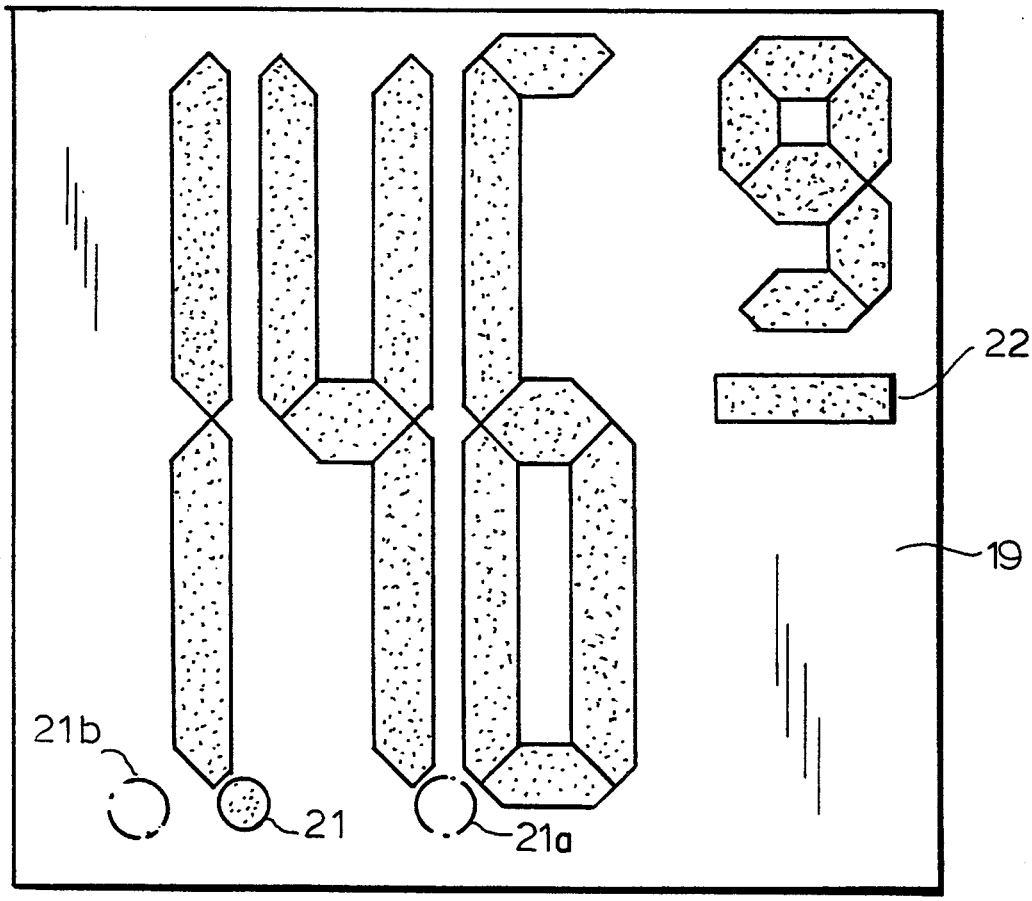
FIG. 4 shows a sign having four alterable numeric symbols and decimal points.

Referring now to FIG. 4, there is shown a sign constructed in accordance with the invention and employing three large numerals and a smaller exponential fractional numeral 9. As illustrated, the three large numerals are 1, 4 and 6 plus the smaller numerator 9, representing, as is frequently done on fuel signs, 9 mills or 9/10th of a cent. The sign and background 19 is of a color(s) or pattern contrasting with one side (stylized) of each of the seven bars or panels 11, 12, 13, 14, 15, 16, 17 presented to display the numeric symbols 1, 4, 6 and 9 wherein the panels are square. Decimal point 21 and bar 22 also contrast with the background supporting structure 19.

Referring back to FIG. 2, it will be seen a contrasting color appears on the depiction of panels 11, 12, 13, 14 and 17. While panel 16 presents a melding or non-contrasting side. The modification shown for panel 15 will be explained hereinafter. In FIG. 3, the contrasting sides of panels 11, 17, 13, 14 and 15 form the numeric symbol 5 and the non-contrasting or melding sides of panels 12 and 16 are not discernible against the background structure 19 (FIG. 4). The contrasting sides have a color or pattern that optically differs from the background of structure 19. The non-contrasting sides blend or meld with the color or pattern of background structure 19. As can be seen in FIGS. 1–5, the surface of background structure 19 forms a plane. Each element 11–17 has a displayed surface which is displayed substantially coplanar to the displayed surface of background structure 19. The background and elements may be exposed to weather.

Figure 5:
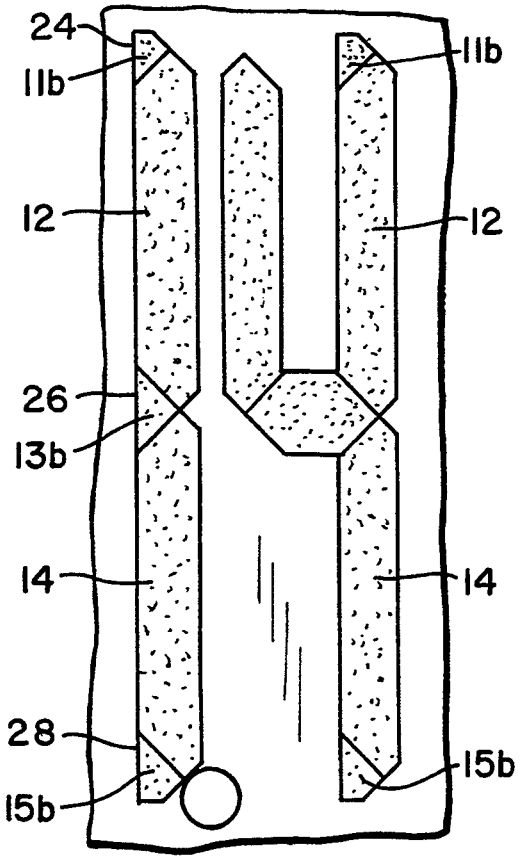
FIG. 5 shows a modification of the horizontal bars to improve the presentation of vertical lines in symbols 1 and 4.

Referring now to FIG. 5 and to panel 15 as shown in FIG. 2, another embodiment of the invention is to provide on the right-hand end of the non-contrasting side of horizontal panels 11, 13 and 15, a triangular mitral portion 11*b*, 13*b* and 15*b* having the contrasting color or pattern. This permits an improved display (FIG. 5) of the vertical line of a symbol, as of the numeral 1 or the full-length vertical line of the numeral 4.

As shown (FIG. 5), the mitral abutting termini of the panels to the right of lines 24, 26 and 28 nest between the adjacent terminal edges of vertical panels 12 and 14. For example, miter 11*b* nests with a miter of panel 12; miter 13*b* with both panels 12, 14; and miter 15*b* with panel 14. This improves the attractiveness of the display as well as the clarity of numerals such as 1 and 4. Thus, the mitered portion 11*b*, 13*b* and 15*b* of the horizontal bars 11, 13 and 15 respectively, fit into and "square out" the numeral I while, similarly, mitered portions 11*b* and 15*b* fill out the top and bottom of the long vertical line of numeral 4.

The decimal points 21, 21*a* and 21*b* are mounted on rotatable axis to optically obliterate or display them selectively.

It should be obvious that the numeral 19 shown in FIG. 4 need not be made in accordance with the invention, particularly where the intended use is a fuel price sign. Other variations for price displays of other products such as produced or groceries might have more or less digits. Also, an entire digit may be optically obliterated, for example, FIG. 4 could display 0.14 or even 14*c*.

The panels need not be arranged to form a digital display 8 of two rectangles as illustrated, since the display may also form the basis FIG. 8 of two squares or a rectangle and a square.

I claim:

1. In a numeric display, a background surface comprising an exposed plane, display means consisting of seven panels, each panel having a front face and a back face one of which is a display face, means for positioning each panel with one of its faces substantially coplanar to the background surface when in a display position, the display faces of said seven panels forming a stylized FIG. 8, said seven panels comprising four vertical panels, two of said four vertical panels disposed in side by side and spaced relation forming the upper sides of the FIG. 8, the other two of said four vertical panels disposed in side by side and spaced relation forming the lower sides of the FIG. 8; means for mounting each of said vertical panels for revolving about a horizontal axis to revolve through the background surface plane, said seven panels further comprising three horizontal panels each of said three horizontal panels disposed between the ends of said side by side panels, means for mounting each of said horizontal panels for revolving about a vertical axis to revolve through the background surface plane, the axis of each of said seven panels passing substantially through the geometric center of the panel and said display faces of said panels contrasting optically with said background and the other of said faces optically melding with said background.

2. A price display for selectively displaying at least one selected number, a background structure comprising a background surface plane, a plurality of flat panels, each of said panels having faces, each panel pivotally secured in said structure and positionable with a displayed one of its faces substantially coplanar to the background surface plane when the displayed face is in a display position, said plurality of flat panels including at least one group of said flat panels consisting of seven of said plurality of panels pivotally mounted to pivot through the background surface plane and arranged to form a digital-type FIG. 8, each of said panels of said group having one of its faces contrasting optically with said background structure and another of its faces non-contrasting optically with said structure, three of said panels of said group being disposed substantially horizontally, two of the four remaining panels of said group being disposed in vertical side by side and spaced relation forming the upper sides of the figure eight, thee other two of said four panels being disposed in vertical side by side and spaced relation forming the lower sides of the FIG. 8; means for mounting said four remaining panels of said group for rotation about substantially horizontal axes passing near the geometric centers of said panels of said group, each of three horizontal panels being disposed between the ends of said side by side panels, means mounting said three of said panels of said group for rotation about substantially vertical axes passing near the geometric center of said three of said panels of said group whereby said panels may be selectably rotated through the background surface plane from a non-contrasting orientation with said background structure to a position wherein said panels contrast with said structure to form a series of symbols including the numbers 0 thorough 9.

3. A display of claim 2 further characterized by a multiplicity of similar groups of seven panels to form similar selected symbols.

4. The device claimed in claim 1 or 2 and further characterized in that said panels have adjacent ends and said adjacent ends are mitered about an axis of each said panel which axis is normal to the panel's pivotal axis, said mitered adjacent ends mating angularly with each other.

5. The device claimed in claim 1 or 2 wherein said panels each have a long axis and a wide axis, and the long axis is substantially longer than the wide axis, and has a pair of edges parallel thereto, and said panels are nestingly mitered about their long axes.

6. The device claimed in claim 1 or 2 wherein said panels are substantially square.

7. The device claimed in claim 1 or 2 wherein selected panels are substantially square.

8. The device claimed in claim 1 or 2 wherein selected panels have at least one mitered end contrasting with said background structure on the face otherwise non-contrasting with said background structure.

* * * * *

UNITED STATES PATENT AND TRADEMARK OFFICE

CERTIFICATE OF CORRECTION

PATENT NO. : 5,388,356

DATED : February 14, 1995

INVENTOR(S) : Timothy Kalivas

It is certified that error appears in the above-identified patent and that said Letters Patent are hereby corrected as shown below:

Column 3, line 19, 22 and 24 change "Fig. 8" to --figure 8--;

column 4, line 1 and 11, "Fig. 8" should be figure 8--;

line 8, "thee" should be --the--;

line 24, "thorough" should be --through--.

Signed and Sealed this

Twenty-third Day of May, 1995

Bruce Lehman

*Attest:*

BRUCE LEHMAN

*Attesting Officer*

*Commissioner of Patents and Trademarks*